US011214991B2

(12) United States Patent
Gabriel

(10) Patent No.: US 11,214,991 B2
(45) Date of Patent: Jan. 4, 2022

(54) ADDITIONAL DOOR HANDLE MODULE FOR A DOOR HANDLE UNIT

(71) Applicant: Huf Hülsbeck & Fürst GmbH & Co. KG, Velbert (DE)

(72) Inventor: Lars Gabriel, Velbert (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 585 days.

(21) Appl. No.: 16/304,750

(22) PCT Filed: May 19, 2017

(86) PCT No.: PCT/EP2017/062080

§ 371 (c)(1),
(2) Date: Nov. 27, 2018

(87) PCT Pub. No.: WO2017/207296

PCT Pub. Date: Dec. 7, 2017

(65) Prior Publication Data

US 2019/0169888 A1 Jun. 6, 2019

(30) Foreign Application Priority Data

Jun. 3, 2016 (DE) ..... 10 2016 110 345.4

(51) Int. Cl.
*E05B 81/76* (2014.01)
*E05B 85/10* (2014.01)
(Continued)

(52) U.S. Cl.
CPC ..... *E05B 81/76* (2013.01); *E05B 79/00* (2013.01); *E05B 79/02* (2013.01); *E05B 81/54* (2013.01); *E05B 85/10* (2013.01)

(58) Field of Classification Search
CPC ..... E05B 81/54; E05B 81/64; E05B 81/76; E05B 81/77; E05B 81/78; E05B 2047/0091; E05B 63/0043; Y10S 292/31
See application file for complete search history.

(56) References Cited

U.S. PATENT DOCUMENTS 6,059,329 A 5/2000 Spitzlcy
6,234,548 B1 5/2001 Mittelbach et al.
(Continued)

FOREIGN PATENT DOCUMENTS

CN 2760185 2/2006
CN 102066679 5/2011
(Continued)

OTHER PUBLICATIONS

Internationaler Recherchenbericht und Schriftlicher Bescheid [International Search Report and the Written Opinion] dated Sep. 15, 2017 From the International Searching Authority Re. Application No. PCT/EP2017/062080 and Its Translation Of Search Report Into English. (17 Pages).
(Continued)

*Primary Examiner* — Carlos Lugo

(57) ABSTRACT

The invention relates to a door handle module (10) for a door handle unit (100) on a vehicle (200), in particular a commercial vehicle (200), said door handle module (10) being used to integrate an electronic unit (20) for the door handle unit (100). The door handle module (10) includes at least one covering element (11) on which at least one electronic element (21) of the electronic unit (20) is arranged, and at least one fastener (12), the door handle module (10) being securable to a module holder (110) on the door handle unit (100) by means of at least one fastener (12).

17 Claims, 5 Drawing Sheets

(51) Int. Cl.

| | |
|---|---|
| ***E05B 79/00*** | (2014.01) |
| ***E05B 81/54*** | (2014.01) |
| ***E05B 79/02*** | (2014.01) |

(56) References Cited

U.S. PATENT DOCUMENTS

| | | | | |
|---|---|---|---|---|
| 6,847,289 | B2 * | 1/2005 | Pang | E05B 81/78 340/426.28 |
| 7,091,823 | B2 * | 8/2006 | Ieda | E05B 81/78 292/336.3 |
| 7,091,836 | B2 * | 8/2006 | Kachouh | E05B 81/78 340/426.28 |
| 7,126,453 | B2 * | 10/2006 | Sandau | E05B 81/78 340/5.61 |
| 7,375,299 | B1 * | 5/2008 | Pudney | E05B 81/78 200/61.62 |
| 7,526,936 | B2 * | 5/2009 | Niskanen | E05B 17/185 70/423 |
| 8,701,353 | B2 * | 4/2014 | Patel | E05B 85/103 49/503 |
| 8,833,813 | B2 * | 9/2014 | Muller | E05B 85/107 292/336.3 |
| 8,904,835 | B2 * | 12/2014 | Bohm | E05B 85/107 70/208 |
| 9,080,352 | B2 | 7/2015 | Aerts et al. | |
| 9,556,643 | B2 * | 1/2017 | Saitou | E05B 79/06 |
| 10,145,152 | B2 * | 12/2018 | Beck | E05B 79/20 |
| 2004/0076014 | A1 * | 4/2004 | Bach | B60N 3/026 362/501 |
| 2005/0236846 | A1 * | 10/2005 | Hidaka | H03K 17/962 292/216 |
| 2006/0226953 | A1 * | 10/2006 | Shelley | E05B 81/78 340/5.62 |
| 2006/0282987 | A1 * | 12/2006 | Shih | E05B 85/10 16/412 |
| 2008/0290668 | A1 * | 11/2008 | Ieda | E05B 81/78 292/198 |
| 2010/0072050 | A1 | 3/2010 | Kubota | |
| 2010/0162777 | A1 * | 7/2010 | Savant | E05B 17/186 70/101 |
| 2011/0012378 | A1 * | 1/2011 | Ueno | E05B 81/78 292/336.3 |
| 2013/0048482 | A1 * | 2/2013 | Saitou | E05B 81/76 200/341 |
| 2014/0125071 | A1 * | 5/2014 | McWilliams | E05B 81/90 292/336.3 |
| 2019/0040660 | A1 * | 2/2019 | Gabriel | E05B 81/78 |

FOREIGN PATENT DOCUMENTS

| | | | | |
|---|---|---|---|---|
| CN | 104228765 | | 12/2014 | |
| DE | 29819472 | | 4/1999 | |
| DE | 19830516 | | 1/2000 | |
| DE | 10000540 | | 8/2001 | |
| DE | 10240828 | A1 * | 3/2004 | B60R 25/25 |
| DE | 102004045152 | A1 * | 3/2006 | E05B 81/78 |
| DE | 102006012063 | | 9/2007 | |
| DE | 102006055100 | | 5/2008 | |
| DE | 102007027845 | | 12/2008 | |
| DE | 102008032820 | A1 * | 1/2010 | E05B 81/76 |
| DE | 102009045871 | | 4/2011 | |
| DE | 102012104889 | | 12/2013 | |
| EP | 1026347 | | 8/2000 | |
| EP | 1245761 | A2 * | 10/2002 | E05B 81/78 |
| EP | 1465119 | A1 * | 10/2004 | G07C 9/00658 |
| EP | 1533450 | A1 * | 5/2005 | B60R 25/406 |
| EP | 1674641 | A1 * | 6/2006 | E05B 81/78 |
| EP | 1801324 | A2 * | 6/2007 | E05B 81/78 |
| EP | 2096237 | A2 * | 9/2009 | E05B 85/16 |
| FR | 2895007 | A1 * | 6/2007 | E05B 81/78 |
| WO | WO-2007025689 | A1 * | 3/2007 | E05B 81/78 |
| WO | WO 2015/128332 | | 9/2015 | |

OTHER PUBLICATIONS

Notification of Office Action and Search Report dated Mar. 9, 2021 From the National Intellectual Property Administration of the People's Republic of China Re. Application No 201780029632.2 and Its Translation Into English. (21 Pages).

Zhu "Foreword and Content", Modern Design of Automotive Body, Qiche Cheshen Xiandai Sheji, 8 P., Mar. 31, 2014.

Mitteilung gemäß Artikel 94 (3) EPÜ [Communication Pursuant to Article 94(3) EPC] dated Sep. 23, 2020 From the European Patent Office Re. Application No. 17726580.8 (4 Pages).

Notification of Office Action and Search Report dated Oct. 30, 2020 From the State Intellectual Property Office of the People's Republic of China Re. Application No. 201780029632.2 and Its Translation Into English. (14 Pages).

Notification of Office Action and Search Report dated Mar. 16, 2020 From the State Intellectual Property Office of the People's Republic of China Re. Application No. 201780029632.2 and Its Translation Into English. (14 Pages).

* cited by examiner

ADDITIONAL DOOR HANDLE MODULE FOR A DOOR HANDLE UNIT

RELATED APPLICATIONS

This application is a National Phase of PCT Patent Application No. PCT/EP2017/062080 having International filing date of May 19, 2017, which claims the benefit of priority of German Patent Application No. 10 2016 110 345.4 filed on Jun. 3, 2016. The contents of the above applications are all incorporated by reference as if fully set forth herein in their entirety.

FIELD AND BACKGROUND OF THE INVENTION

The present invention relates to a door handle module for a door handle unit of a vehicle, in particular of a commercial vehicle, in accordance with the independent device claim, and also to a door handle unit for actuating a lock of a movable part of a vehicle in accordance with the further independent claim, and to a method for retrofitting an electromechanical or electrical access control system to a vehicle in accordance with the independent method claim.

Door handle units for vehicles may sometimes have a long series life, so the corresponding models of the door handle units are used over a long period, in particular on commercial vehicles. Accordingly, functionalities of modern door handle units are lacking in door handle units in the genre, since for vehicles with a long period of service the product lifecycle is correspondingly lengthened, so that the range of functions of door handle units which are already built-in is limited due to the lack of electronic functions.

The object of the invention is to remedy the above disadvantages known from the prior art at least in part. In particular, the object of the present invention is to make available an extended range of functions for existing door handle units on vehicles, in particular commercial vehicles, and preferably to improve comfort and/or security in security systems, in particular access control systems and/or systems for car-sharing or hire cars.

The above object is achieved by a door handle module having the features of the first independent device claim, a door handle unit with the further independent claim, and a method in accordance with the independent method claim.

Further features and details of the invention will become apparent from the dependent claims, the description and the drawings. In this case, features and details which have been described in conjunction with the door handle module according to the invention of course also apply in conjunction with the door handle unit according to the invention and/or the method according to the invention, and conversely in each case, so that with respect to the disclosure reference always is or can be made reciprocally to the individual aspects of the invention.

The measures cited in the dependent claims make advantageous developments and improvements of the subjects of the invention stated in the independent claims possible.

SUMMARY OF THE INVENTION

According to the invention, a door handle module for a door handle unit of a vehicle, in particular of a commercial vehicle, for integrating an electronics unit for the door handle unit is proposed. The door handle module has at least one covering element, on which at least one electronic element of the electronics unit is arranged. Furthermore, the door handle module comprises at least one fastening means, by means of which the door handle module can be fastened to a module receptacle (also referred to below as "receptacle" for short) of the door handle unit by at least one fastening means. The electronics unit may serve according to the invention to provide wireless communication capability, wherein it is possible in particular to effect control of an access control system or security system, as a result of which comfort and security can be improved. For this, provision may be made for the electronics unit to be configured such that sensing of the approach of an operator, and a data exchange with an ID transmitter or a mobile phone for access control of a security system can be carried out by the electronics unit. The door handle module according to the invention may in this case be integrated preferably in or on an already existing and/or technically present door handle unit of a vehicle, in particular a commercial vehicle, also as a retrofit in old vehicles or as additional equipment in new vehicles. Integration in the context of the invention may also be understood to mean hardware migration. Accordingly, with existing door handle systems new hardware—according to the invention here this is the electronics unit for an extended range of functions—can be integrated while retaining the door handle unit structure. It is preferred in this case if the door handle module with the electronics unit is integrated in the already existing vehicle electronics or the control system of the vehicle electronics, so that for example a central locking system or security system which is present can be brought into a signal connection with the electronics unit of the door handle module. Furthermore, it is conceivable for the electronics unit to serve to store driving data, for example a logbook, user profiles or wear-related vehicle data. The door handle module according to the invention may in this case preferably be adapted in terms of design and haptic to the existing door handle unit of the vehicle, so that, once the door handle module has been mounted on the vehicle by means of at least one fastening means on the receptacle of the door handle unit, a visually and/or haptically pleasing impression can be produced. A (module) receptacle in/on which the door handle module can be fastened by means of at least one fastening means may according to the invention be a receptacle already present on the door handle unit or a receptacle to be produced for it. Accordingly, it is conceivable for a recess and/or a cavity on the door handle unit to serve for receiving the door handle module. In this case, it is conceivable for the receptacle to be provided on a door handle itself or on a part of the vehicle body or on a component of the door handle unit which is arranged on the vehicle body. By means of the fastening means, the door handle module may be fastened to the (module) receptacle of the door handle unit for example in non-positive manner, in positive manner and/or by a material-formed bond. Furthermore, the door handle module may be arranged in portions on a side of the door handle unit facing away from the vehicle and at the same time in portions in the door or in the door handle unit, in order optimally to utilize the space available. In such case, it is preferable if at least the one electronic element is arranged on the side facing away from the vehicle, in order to ensure in particular communication capability of the electronics unit. In order that a visually pleasing impression of the door handle module can be produced, it is preferable if the door handle module, in particular the covering element, is formed as an injection-molded plastics material part, in particular a 2-component injection-molded plastics material part. In terms of plastics, preferably polyamides, polycarbonates, acrylonitrile/butadiene/styrene copolymers (ABS), polymethyl methacrylate (PMMA) or acrylonitrile/styrene/acrylate copolymers (ASA) are conceivable. In this case, the covering element may be painted, chromium-plated, coated or colored-through in order to adapt the appearance to the vehicle or the door handle unit.

Advantageously, the (module) receptacle of the door handle unit can be closed by the covering element at least on a side facing away from the vehicle, wherein in particular the covering element can be arranged at least in portions flush-mounted on the door handle unit. This achieves the advantage that the electronics unit is protected from external influences, for example moisture and/or dirt. Furthermore, an attractive and pleasing configuration of the door handle unit can be achieved by an in particular flush-mounted arrangement of the covering element on the door handle unit. Furthermore, by closing the receptacle, in particular a flush-mounted covering of the receptacle, risks of injury are minimized, so no sharp edges, protruding components or similar have an adverse effect on handling.

In the context of the invention, the covering element may be designed at least in portions to be electrically conductive, wherein in particular the electronic element is formed at least in portions by the covering element. For this, the covering element may have conductive structures, these preferably being antenna and/or electrode structures, which rest for example on a resonant element, such as an inverted-F antenna, or other types of antenna resonant elements, or in particular capacitive electrode elements. Correspondingly, the covering element has conductive electronic structures which preferably run in the interior or in a region of the covering element facing away from the vehicle, in order to achieve galvanic isolation from the outer surface. For this, the electronic element may for example be arranged in a surround of the covering element or be encapsulated by a plastics material. Also, this may in this case be an electrically conductive plastics material, wherein the electronic element is configured such that communication capability can be produced via the electronic element, so that for example signals can be transmitted and/or received by the electronic element.

Advantageously, the electronic element may have at least one sensor element and/or at least one wireless communication element, in particular a near-field and/or non-near-field communication element, by means of which a data exchange with a communication unit which is configured to be in particular portable/mobile for a user can be set up. In this case, the electronic element may be designed as a transmission and/or reception unit. The sensor element may according to the invention be designed as a capacitive or inductive sensor which recognizes the approach of a user preferably in contactless manner. The electronics unit upon recognition of the approach of a user may correspondingly set up a data exchange with a communication unit, for example in the form of an ID transmitter, a mobile phone and/or a smartphone, as a result of which a security query and/or a wish to activate opening can be carried out. A wireless communication element may in this case be designed in the form of a radio-frequency transceiver and/or an antenna structure. Likewise it is conceivable for the wireless communication element, in particular in the form of a radio-frequency transceiver, to include near-field and/or non-near-field communication elements which operate in a near-field communication band and/or a non-near-field communication band. A non-near-field communication element can operate in one or more non-near-field communication bands. According to the invention, provision may be made for near-field and non-near-field communication elements, for example in the form of antenna structures, to be arranged together on the door handle module, in particular spaced apart from each other. In this case, it is conceivable for a combinatorial switching logic to make it possible to couple the near-field communication functions and the non-near-field communication functions at a common communication element. In this case, signals can be received and/or transmitted both at the near-field and the non-near-field communication elements. The sensor element and/or the wireless communication element, in particular a near-field and/or non-near-field communication element, may in this case be arranged on a front side and/or side facing away from the vehicle of the door handle module, in particular of the covering element. For wireless communication of the wireless communication element, in particular a near-field and/or non-near-field communication element, antenna structures may be provided which operate in a near-field communication band such as a 13.56 MHz band, or alternatively a non-near-field communication band. Near-field communication typically includes communication distances of less than approximately 20 cm. Non-near-field communication, also referred to as far-field communication, typically includes communication distances of several meters. The electronics unit and/or the electronic element may for example have a signal-combining switching logic, such as a duplexer or comparable switching logic, in order to make it possible for a near-field communication element and a non-near-field communication element to utilize the antenna structures jointly. Accordingly, a saving can be made on costs and installation space by reducing components. The electronic element and/or the electronics unit may in this case be designed such that control algorithms which control the use of antenna structures of the wireless communication element and/or the sensor element are implemented. In this case, the electronic element and/or the electronics unit can perform and/or control signal quality monitoring functions, sensor monitoring functions and other data acquisition operations.

It is conceivable according to the invention for the electronic element to be connected to the at least one sensor element and/or the at least one wireless communication element, in particular the near-field and/or non-near-field communication element, by means of a signal connection, by means of which data and/or electrical energy can be transmitted. The signal connection may according to the invention be designed as a cable connection and/or be wireless. In this case, for example the electronic element and/or the electronics unit can perform and/or control signal quality monitoring functions, sensor monitoring functions and other data acquisition operations via the signal connection.

In the context of the invention, at least a communication between a security system of the vehicle and the communication unit via the near-field and/or non-near-field communication element can be carried out by the electronic element, wherein in particular an activation of a security system of the vehicle can be carried out. A communication unit according to the invention may for example be an ID transmitter, a mobile phone and/or a smartphone. The communication between a security system of the vehicle and the communication unit serves according to the invention to transmit a security code and/or a wish to activate opening, wherein it is possible in particular to activate a security system of the vehicle. The communication can accordingly trigger a query, as a result of which an identification for authorization for access to the vehicle can be carried out.

It is furthermore conceivable for the electronic element to be able to be converted into a rest state and also into a wake state, wherein in particular by the electronics unit (20) a wake signal of the vehicle (200), in particular of the security system and/or of the communication unit (30), can be received. A rest state according to the invention may be understood for example as an energy-saving mode, wherein the electronic element can be converted by a received wake signal into a wake state in which there is an increased energy consumption compared with the rest state. Wake signals in this context designate in particular signals with information which is suitable to trigger an authentication operation with the security system. The received signals or information may be made available e.g. by means of the interface of the communication element. In this case, the vehicle-side security system may have an access system (e.g. central locking system for vehicle doors or tailgates) which have active keyless entry, passive keyless entry or Keyless-Go functionalities. The security system thus serves e.g. for keyless activation of an access system for vehicles, in particular commercial vehicles. To this end, in particular an authentication operation initiated by the wake signal or following on from the receiving of the wake signal is necessary for activation. Due to the authentication operation, functions of the security system can be activated and/or deactivated by the vehicle, such as opening or closing a locking device of the vehicle, e.g. also doors or gates in the rear section and/or side region of the vehicle, starting the engine or activating or deactivating the immobilizer.

In the context of the invention, the electronic element may preferably have a Bluetooth, NFC, infrared, GSM, LTE, UMTS, mobile communications, HF, UHF, LF, WLAN and/or USB interface, so that in particular a data exchange with the communication unit can be carried out. For this, the electronic element may preferably have an antenna structure, the antenna structure having e.g. an antenna coil with or without a ferrite core, a powder core or other ferromagnetic materials. An antenna structure printed on a printed circuit board, a patch antenna or a planar inverted F-shape (PIF) antenna may also be provided as the antenna structure, which may be integrated in particular directly on the printed circuit board, and may have e.g. a wound antenna or a 3D antenna for position-independent reading-out. In this case, the antenna structure may be arranged preferably at least in portions in the covering element. Furthermore, the communication element may have a plurality of antennas or precisely one antenna. As a result, a space-saving arrangement of the antenna is achieved and adequate reception is ensured regardless of the orientation of the module unit. Due to the use of LF signals and/or NFC signals, in addition the range, e.g. of reception of the wake signal, can be reduced in order to prevent unauthorized interception of the signal. It is also conceivable for the same communication element of the electronic element to be configured for data exchange with the vehicle electronics, as a result of which optimal attachment to the vehicle can be achieved. Likewise, an additional communication element which serves in particular exclusively for communication with the vehicle or the vehicle electronics (and not with the communication unit) may be provided in the electronics unit.

It is furthermore conceivable for the fastening means to make possible at least positive, non-positive and/or material-formed fastening with the door handle unit. This increases the operational reliability for the door handle module, since the fastening can prevent unintentional detachment or loss. Furthermore, thus rattling or protrusion of the door handle module out of the door handle unit can be prevented, as a result of which damage can be prevented and injuries avoided.

The fastening means may be configured according to the invention as a fastening adapter, wherein the fastening adapter can be arranged in the receptacle of the door handle unit and serving as a receptacle for the fastening means, the electronic element and/or an electric power module, wherein in particular the signal connection is arranged on the fastening means, in particular the fastening adapter. According to the invention, the fastening adapter may firstly be configured as a mechanical adapter or connector for the door handle module and/or as an electromechanical adapter for connecting the electronics unit and/or the electronic element to vehicle-side electronics. As a purely mechanical fastening adapter, it can serve as a receptacle for the electronic element and/or an electric power module. The fastening adapter in this case may have the electronic element and/or an electric power module for the electronic element or the electronics unit, wherein the electronic element and/or the electric power module can be held, at least in portions, by the fastening adapter in non-positive and/or in positive manner. In this case, it is likewise conceivable for an electronic element arranged on the covering element to extend at least in portions through the fastening adapter into the door handle unit or the door. Accordingly, a part of the electronics unit and/or of the electronic element and/or of the electric power module can additionally be protected from external influences within the fastening adapter or the door. Furthermore, a saving can be made on installation space and a visually pleasing impression of the door handle unit, in particular of the door handle module, can be achieved. The fastening adapter may also be designed as an electronic and mechanical connection between the electronic element and the sensor element and/or communication element, for example in the form of a plug with integrated connecting lines or signal connections.

It is furthermore conceivable for the fastening adapter and/or the covering element to have a guide portion, wherein the guide portion, at least in portions, is designed to be cylindrical, in particular geometrically complementary to the handle module receptacle of the door handle unit. The fastening adapter and the covering element may be designed in one part, in particular of uniform material, so that the door handle module is produced as a structural element substantially designed in one part which can be inserted into the door handle unit substantially from outside the vehicle, wherein the guide portion, at least in portions, is designed to be cylindrical, in particular geometrically complementary to the receptacle of the door handle unit, so that simplified mounting is made possible. The guide portion in this case may serve for an accurately positioned arrangement of the fastening adapter and/or the covering element in the receptacle of the door handle unit to be able to be achieved. For this it is conceivable for the guide portion to have one or more guide elements or guide lugs which substantially prevent incorrect insertion of the door handle module into the door handle unit. Furthermore, it is conceivable for the fastening adapter to be configured such that it has a clamping effect within the receptacle, as a result of which a clamping force can be transmitted from the fastening adapter to the receptacle. Furthermore, latching lugs may be formed on the fastening adapter, with the latching lugs preferably latching within the receptacle of the door handle unit, so that a non-positive connection between the door handle module and door handle unit can be achieved. The fastening adapter and/or the latching lugs of the fastening adapter in this case are preferably configured flexibly such that for introduction of the fastening adapter into the receptacle the latching lugs can be compressed at least in portions and do not latch in positive and/or in non-positive manner within the receptacle until the final mounting position is attained. The guide portion of the fastening adapter may in this case be designed to be cylindrical, in particular geometrically complementary to the receptacle of the door handle unit, so that as play-free as possible mounting of the door handle module in the receptacle is made possible.

The fastening adapter and/or the fastening means may be designed as a quick-release closure, bayonet lock, screw closure or latch closure. Accordingly, the fastening adapter and/or the fastening means may be arranged in non-positive manner and/or in positive manner in/on a receptacle of the door handle unit, the fastening being possible in a particularly simple and reliable manner.

Advantageously, the fastening adapter may have at least one fastening arm, wherein in particular the fastening arm is designed to be orthogonal to the guide portion and able to be connected in non-positive and/or in positive manner to the door handle unit, as a result of which the fastening adapter can be fixed to the door handle unit. The fastening arm in this case may be configured such that latching with part of the module receptacle can be achieved. For this, the fastening arm may be designed to be for example elastic or resilient.

In the context of the invention, the covering element may have at least one seal and/or one gluing portion. The seal may serve to protect the electronics unit from ingress of moisture and/or dirt, wherein it is possible for in particular ingress of moisture to damage the electronics unit, and in winter for freezing moisture to result in destruction of the covering element. Accordingly, improved protection and hence a longer life can be achieved. Gluing may for example serve to reduce the amount of gap between the covering element and door handle unit and to make secure holding possible.

According to a further aspect of the invention, a door handle unit for actuating a lock of a movable part of a vehicle, in particular of a door, gate or the like, for a vehicle with a door handle for mechanical opening of the movable part by a user is proposed, the door handle unit having at least one receptacle in which a door handle module according to the invention can be arranged. Thus a door handle unit according to the invention entails the same advantages as have been described extensively with reference to the door handle module according to the invention. The door handle unit has a component portion arranged on a side facing away from the vehicle and a portion which protrudes into the movable part, the door handle module, in particular the covering element, being arranged on the side facing away from the vehicle. It is furthermore conceivable for the door handle unit to have an outer shell, for example in the form of a screen, on which the door handle module, in particular the covering element, is arranged at least in portions. For this, the door handle module, in particular the covering element, is adapted visually to the outer shell or screen of the door handle unit, so that a visually pleasing impression is produced. Furthermore, the door handle module, the electronics unit and/or the electronic element of the electronics unit may be fastened to the door handle unit and/or to the outer shell. For this, the door handle unit, the receptacle and/or the screen of the door handle unit may have fastening-means receptacles or separate fastening means, which can be brought for example into operative connection with the fastening elements of the door handle module. Preferably, the fastening means or the fastening-means receptacle is/are located on a side facing the vehicle within the movable part. Provision may advantageously be made for a receptacle for the door handle module to be arranged on a door handle support of the door handle unit.

According to the invention, it is conceivable for a proximity sensor to be provided which senses the approach of a user and is in a signal connection with the security system, so that a wish to activate opening of the movable part can be detected and in particular a wake signal can be generated, wherein particular the proximity sensor is arranged on the module receptacle and/or on the door handle module. The proximity sensor may in this case be for example a capacitive or inductive sensor which recognizes an operator and/or an ID transmitter, a mobile phone or a smartphone or tablet or smartwatch which the person is carrying, and thereupon generates a wake signal for the security system.

Advantageously, the door handle module may be designed to be substantially flush-mounted with the door handle unit, with in particular the door handle module having at least one cutout for a door handle recess. The door handle module is preferably arranged in the region of the door handle, in particular in a region in or around a recessed grip in the region of the door handle. The door handle module, in particular the covering element of the door handle module, in this case is configured geometrically such that the outer contours of the door handle module, in particular of the covering element, run flush, in particular flush-mounted, along the outer contours of the door handle recess and/or of the door handle. As a result, at least from a front view of the door handle unit the door handle module, in particular the covering element, is scarcely or not at all visually perceptible. For this, the door handle module, in particular the covering element, may have a cutout and/or a contour corresponding to the door handle recess and/or the door handle.

In the context of the invention, it is conceivable for the door handle unit and/or the door handle module to be an injection-molded plastics material part, in particular a 2-component injection-molded plastics material part, wherein at least the electronics unit and/or the electronic module being encapsulated at least in portions. Owing to the fact that the electronic module and/or the electronics unit is integrated in the door handle unit or the door handle module, the components are protected from external influences. Furthermore, it is conceivable for the door handle module and/or the door handle unit to be manufactured from two different plastics materials. In this case, for example the covering element of the door handle module may be manufactured from a first plastics material and a part of the door handle module which protrudes into the movable part may be manufactured from a further plastics material. The outside part of the door handle module may in this case preferably be manufactured from a resistant plastics material, so that improved protection from external influences and attempts at manipulation is provided. That part of the door handle module or of the door handle unit which protrudes into the movable part may on the other hand be formed by a more beneficial, not so resistant plastics material.

Advantageously, the receptacle may be a lock cylinder receptacle for a mechanical lock cylinder, and the door handle module may be fastened in the lock cylinder receptacle by means of at least one fastening means. Accordingly, a mechanical lock cylinder which is present can be removed from the door handle unit, in particular the door handle support, and be replaced by a module according to the invention, which makes retrofitting or additional equipping with the door handle module according to the invention particularly simple. This makes it possible in a particularly simple and inexpensive manner to integrate an electronics unit of a door handle module in the door handle unit. No major cost-intensive conversion measures are necessary for this, so existing door handle units can continue to be used or already-mounted door handle units can be supplemented by door handle modules according to the invention. Thus the mechanical lock cylinder can be substituted in simple manner by the (mobile) communication unit already described.

According to a further aspect of the invention, a method for retrofitting an electromechanical or electrical access control system on a vehicle, in particular a commercial vehicle, is claimed, wherein on a door handle unit, in particular on a door handle unit according to the invention, a door handle module according to the invention is fastened in a receptacle, in particular a lock cylinder receptacle for a mechanical lock cylinder. Thus all the advantages which have already been described in conjunction with the door handle module according to the invention and the door handle unit according to the invention are also yielded in conjunction with the method according to the invention. Preferably the door handle module is mounted in a receptacle already present in the door handle unit, in particular on a lock cylinder receptacle. The lock cylinder which may be present is accordingly removed from the lock cylinder receptacle and replaced by the door handle module according to the invention. In this case, a signal connection to an access control system which is already present, for example a central locking system, can be produced, so that an extended function for the access control or security system can be attained by means of the door handle module. For this, the electronics unit of the door handle module may perform an electrical or electromechanical function, it being possible to perform a data exchange with an ID transmitter, a smartphone, a smartwatch or a tablet via a communication element.

Preferably, the door handle module according to the invention, in particular the covering element of the door handle module according to the invention, is arranged, placed on and/or inserted on a side facing away from the vehicle from a region of the door handle unit which is visible from the outside.

According to the invention, it is conceivable for a wake signal of the vehicle, in particular of the security system and/or of the communication unit, to be able to be received by the door handle module, with in particular the wake signal is generated by a proximity sensor as the result of a user approaching.

BRIEF DESCRIPTION OF THE SEVERAL VIEWS OF THE DRAWINGS

Further measures improving the invention will become apparent from the following description of several examples of embodiment of the invention, which are illustrated schematically in the figures. All the features and/or advantages, including design details, spatial arrangement and method steps, arising from the claims, the description or the drawings may be essential to the invention both per se and also in very widely-varying combinations. In this case, it should be taken into account that the figures are only descriptive in nature and are not intended to restrict the invention in any form.

The Figure show in.

In the following figures, the identical reference numerals are used for the same technical features for different examples of embodiment as well.

DESCRIPTION OF SPECIFIC EMBODIMENTS OF THE INVENTION

The preceding explanation of the embodiments describes the present invention exclusively in the context of examples. Of course, individual features of the embodiments, in so far as it is technically sensible, may be combined freely together without departing from the scope of the present invention.

Figure 1:
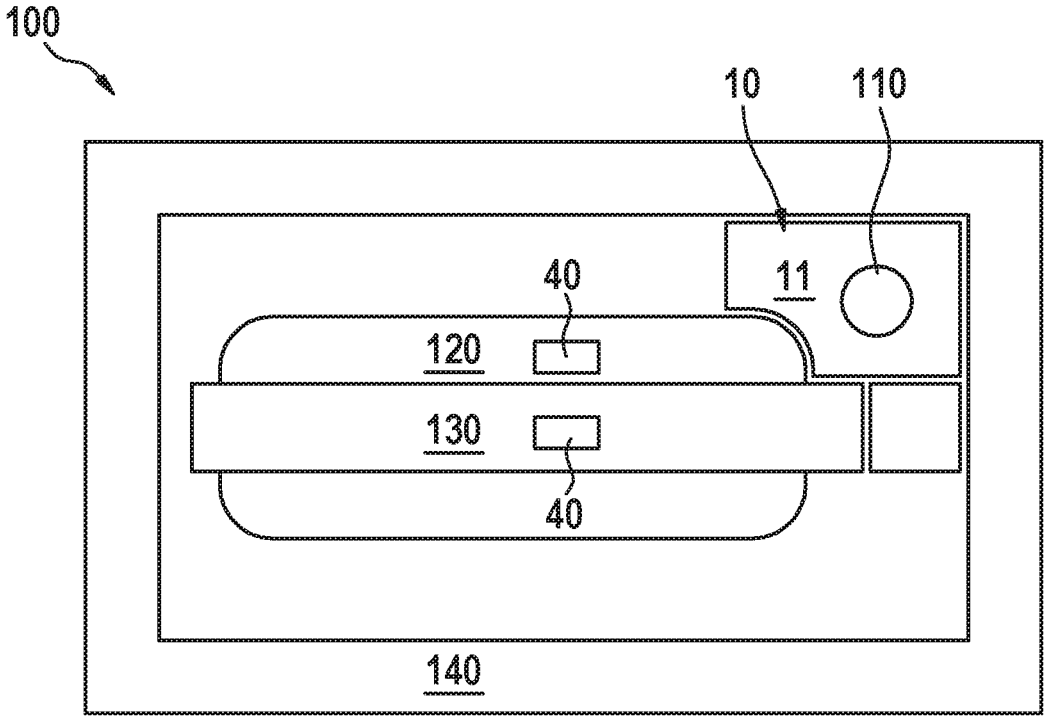
FIG. 1 a door handle unit according to the invention with a door handle module according to the invention, FIG. 2 a further embodiment of the door handle unit according to the invention with a door handle module according to the invention, FIG. 3*a* an embodiment of a covering element with an electronics unit, FIG. 3*b* a further embodiment of a covering element with an electronics unit, FIG. 4 a detail of a door handle unit with a detail of a door handle module according to the invention, FIG. 5 a side view of a door handle unit according to the invention, FIG. 6 a top view of a door handle unit according to the invention, FIG. 7 a rear view of a door handle module according to the invention, and FIG. 8 a vehicle with a door handle unit according to the invention and a door handle module according to the invention.

FIG. 1 shows a door handle unit 100 according to the invention, the door handle unit 100 having a door handle recess 120 with a door handle 130 arranged there which are arranged on an outer shell 140 of the door handle unit 100. According to the invention, the door handle 130 may be a door handle 130 which is designed to be rigid or movable. Furthermore, the door handle unit 100 in FIG. 1 has a module receptacle 110 in the form of a lock cylinder 110 or a lock cylinder receptacle 110, on which the door handle module 10 according to the invention is arranged. The module receptacle 110 in this case is arranged on the outer shell 140 above the door handle 130 and the door handle recess 120. The door handle module 10 in this case has a covering element 11 which has a cutout 13 in the region of the door handle recess 120, so that the door handle module 10, in particular the covering element 11, is adapted to the outer contour of the door handle recess 120, of the door handle 130 and to part of the outer shell 140. The covering element 11 in this case completely closes the module receptacle 110 and lies substantially in flush-mounted manner against the outer shell 140 of the door handle unit 100. The covering element 11 or the door handle module 10 may in this case be an injection-molded part, in particular a 2-component injection-molded part, with the covering element 11 preferably being able to be colored or colored-through such that there is no difference in color from the outer shell 140, the door handle 130 and the door handle recess 120.

Figure 2:
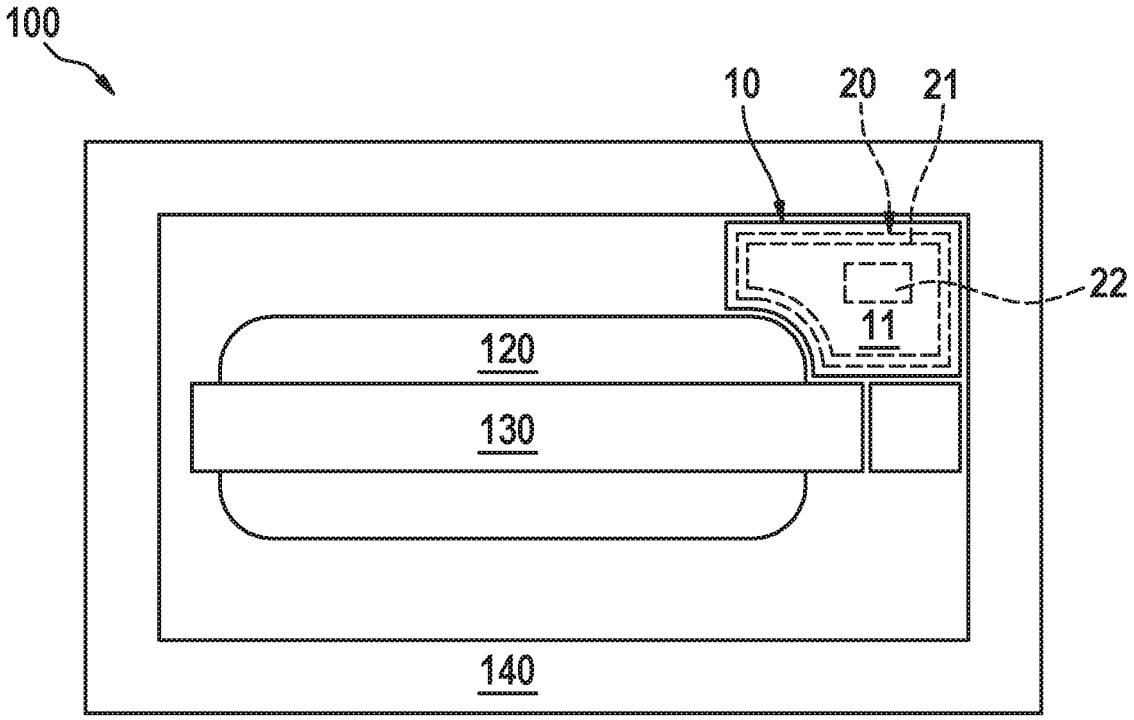

FIG. 2 shows a further example of embodiment of the door handle unit 100 according to the invention. Comparably to FIG. 1, the door handle unit 100 in FIG. 2 has an outer shell 140 with a door handle recess 120 arranged thereon and a door handle 130. In a region above the door handle recess 120 and the door handle 130 there is located the door handle module 10. In this case, the door handle module 10 has the covering element 11 which has a cutout 13 in the region of the door handle 130 and the door handle recess 120. Furthermore, the door handle module 10 has an electronics unit 20. On the covering element 11 there are arranged two electronic elements 21, being firstly a sensor element 21.1, which is designed as a proximity sensor 21.1, and a communication element 21.2. The sensor element 21.1 serves according to the invention to detect the approach of a user to the door handle unit 10, in particular the door handle module 10. The communication element 21.2 serves for communication, in particular with a communication unit 30 which the user is carrying. The communication element 21.2 may according to the invention be a near-field and/or non-near-field communication element 21.2, by means of which a data exchange with a communication unit 30 can be set up.

Figure 3A:
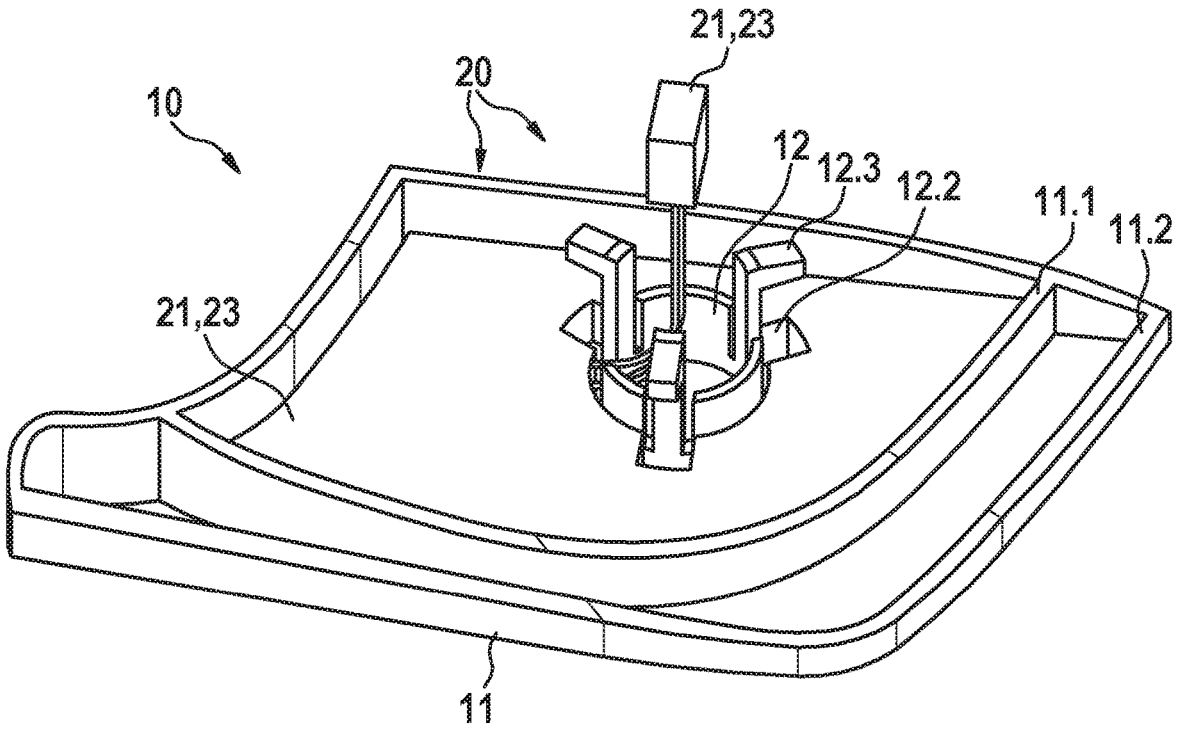

FIG. 3*a* shows the covering element 11 of a door handle module 10 according to the invention with an electronics unit 20. The electronics unit 20 in this case consists of the electronic element 21 and a communication element 21.2 connected thereto by means of a transmission element 21.3. Thus a signal connection 21.3 between the electronic element 21 and the communication element 21.2 can be produced, so that data can be received and/or transmitted. The covering element 11 in this case has a cutout 13 for the region on a door handle recess 120 or on a door handle 130, and also a gluing portion 11.2 along the outer contours of the covering element 11, by means of which portion the covering element 11 can be glued to a part of the outer shell 140. The gluing portion 11.2 in the installed state thus points in the direction of the vehicle interior and in this case is glued in positive manner and/or by a material-formed bond to the outer shell 140 of the door handle unit 100. Spaced apart from the gluing portion 11.2 there may be arranged a seal 11.1, so that the electronics unit 20 is protected from external environmental influences. In a cavity of the covering element 11 there is arranged a communication element 21.2 and the fastening means 12. The fastening means 12 has a guide portion 12.2 and three fastening arms 12.3, the guide portion 12.2 being configured such that it can be received in the module receptacle 110, in particular in the form of a lock cylinder receptacle, and latches with the fastening arms 12.3.

Figure 3B:
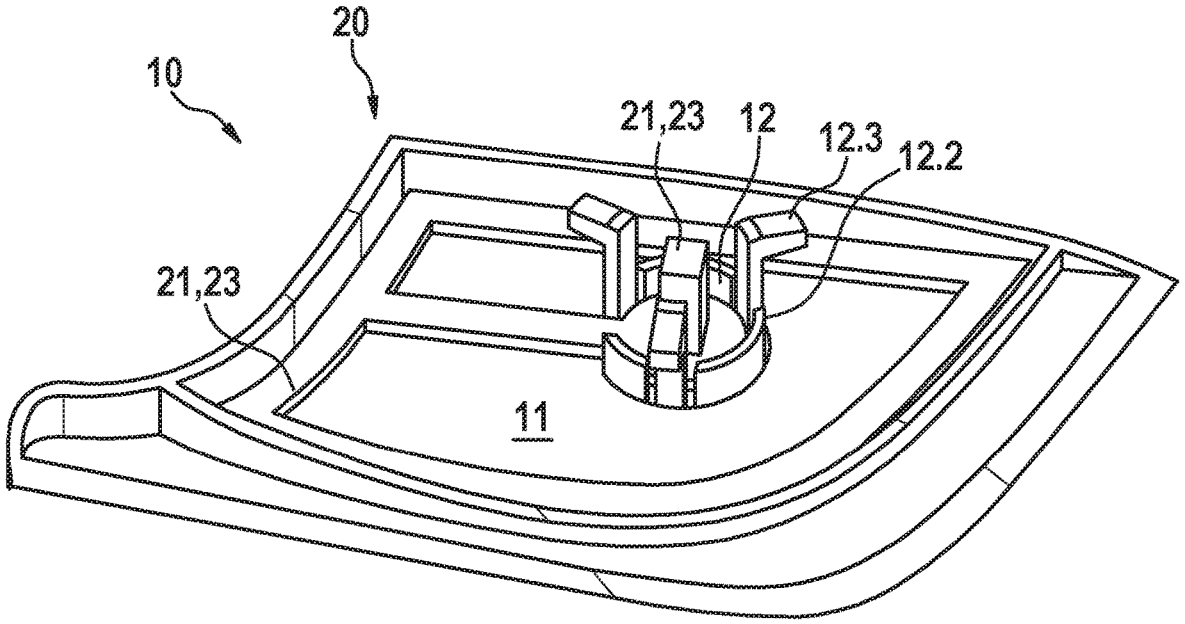

FIG. 3*b* shows a further example of embodiment of a covering element 11 of the door handle module 10, with, in contrast to FIG. 3*a*, the communication element 21.2 being formed into a cavity of the covering element 11 only in portions and extending along the outer contours of the cavity of the covering element 11 and also into the guide portion 12.2 of the fastening means 12.

Figure 4:
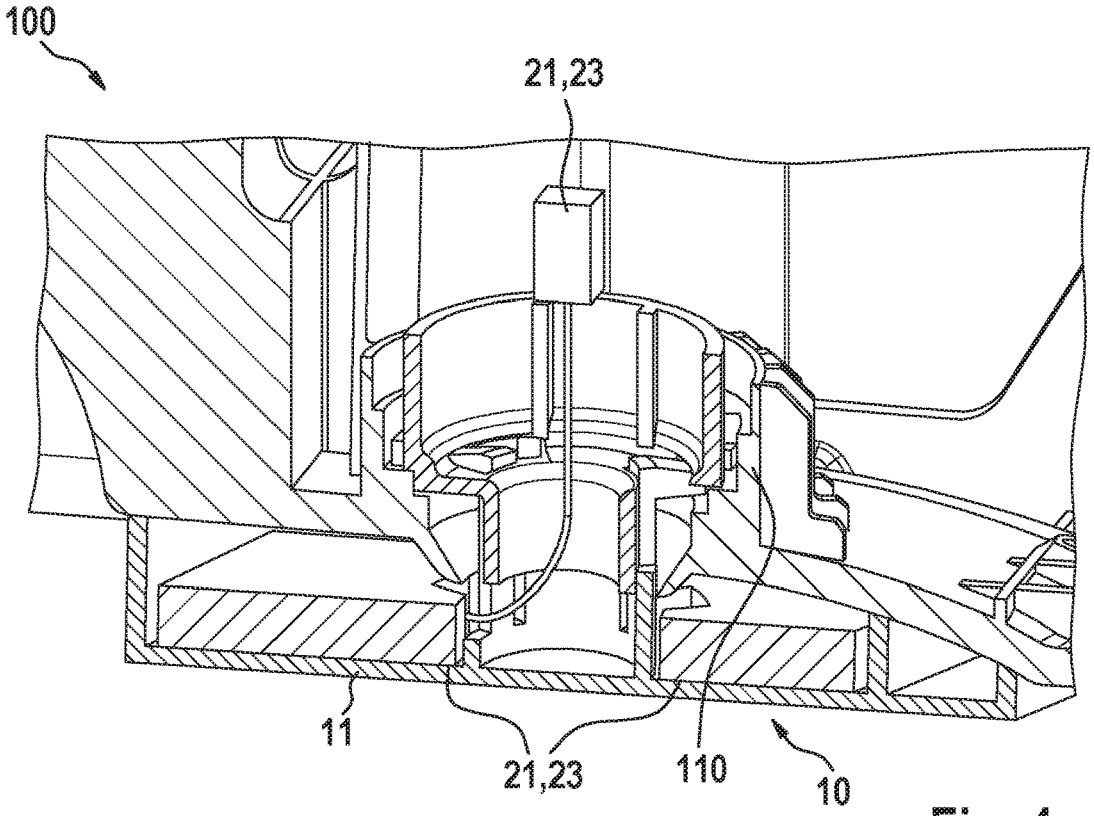

FIG. 4 shows a detail of a door handle unit 100 according to the invention in a detail of a door handle module 10 according to the invention, being a sectional view through the door handle unit 100 and the door handle module 10. The door handle module 10 in this case has a covering element 11 with a communication element 21.2, the communication element 21.2 being connected by means of a transmission element 21.3 to an electronic element 21 in the region of the module receptacle 110. The signal connection between the communication element 21.2 and the electronic element 21 in a cavity of the covering element 11 which can thus be produced in this case runs within the guide portion 12.2 and into the fastening adapter 12.1. The electronic element 21 is arranged in the region of the fastening adapter 12.1. The guide portion 12.2 latches with the fastening adapter 12.1 in the interior of the door handle unit 100 with the aid of the fastening arms 12.3. As can be seen in FIG. 4, the covering element 11 in the region of the door handle unit 100, in particular in the region of the outer shell 140, closes in flush-mounted manner therewith.

Figure 5:
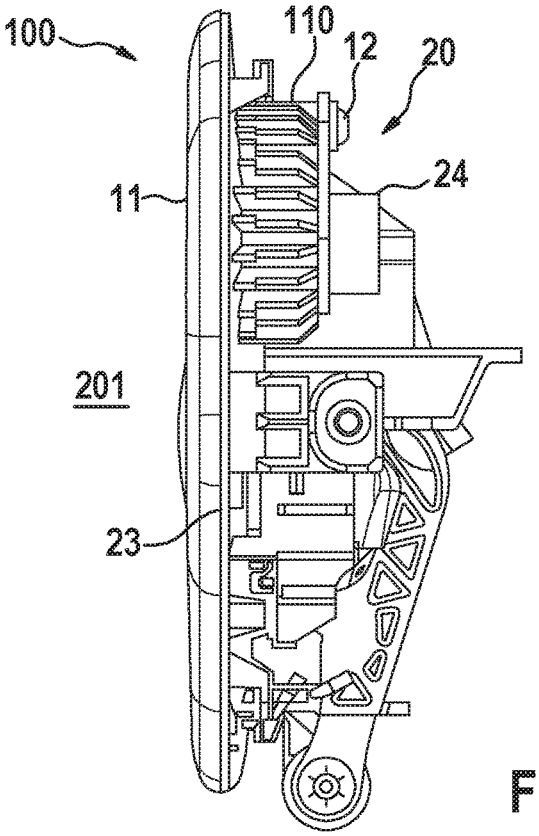

FIG. 5 shows a side view of the door handle unit 100 according to the invention. The door handle unit 100 has an outer shell 140 which can be arranged on a movable part 202 of the vehicle 200 on the side 201 facing away from the vehicle 200. On the outer shell 140, the door handle module 10 is arranged from the outside on the door handle unit 100. The covering element 11 in this case is designed flush-mounted with the outer shell 140 of the door handle unit 100. On a side 202 of the door handle unit 100 facing the inside of the vehicle, there extends a part of the door handle module 10 with the electronics unit 20. The electronics unit 20 in this case has a power module 22 for supplying electricity to the electronics unit 20. Furthermore, a fastening means 12 for non-positive fastening of the door handle module 10 on the module receptacle 110 is arranged on the door handle module 10. In such case, this is a screw, with which the door handle module 10 can be connected in non-positive manner to the module receptacle 110. FIG. 5 furthermore shows a sensor element 21.1, which is arranged in circumambient manner along the outer shell 140 of the door handle unit 100. The sensor element 21.1 may in this case be designed as a capacitance sensor, in particular as an approach sensor 21.1, so that a user approaching the door handle unit 100 can be sensed.

Figure 6:
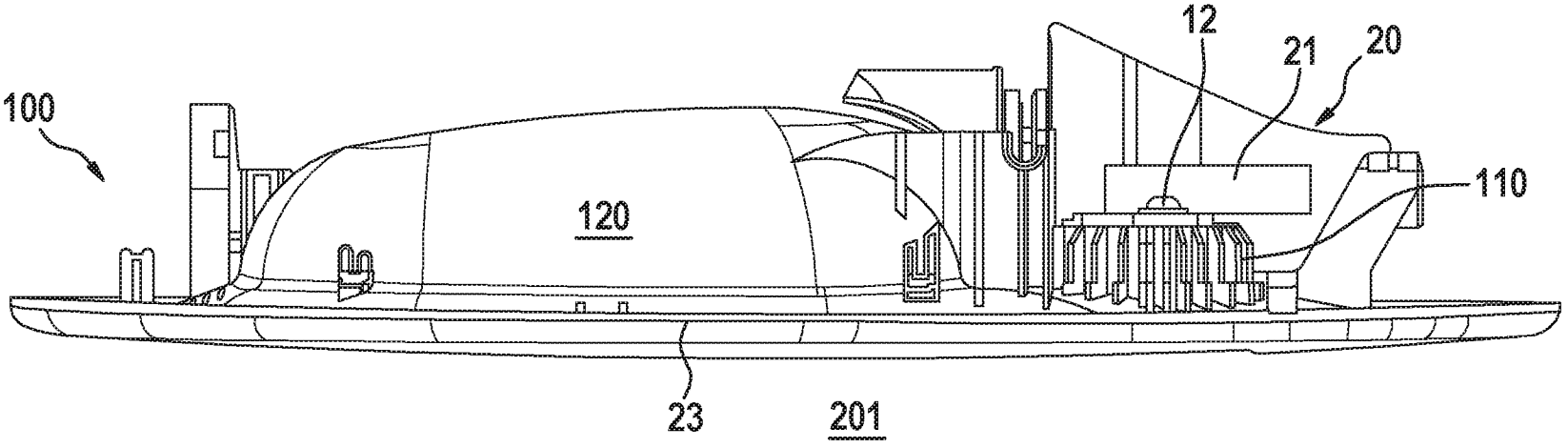

FIG. 6 shows a further view of the door handle unit 100 according to the invention, with the door handle unit 100 having a door handle recess 120, an outer shell 140 and a module receptacle 110. The electronics unit 20 is arranged on the module receptacle 110, and has at least one electronic element 21 which extends inwards on the side 203 facing the inner vehicle wall. The electronics unit 20 or the door handle module 10 in this case is connected in non-positive manner to the module receptacle 110 with the fastening means 12 on the rear side of the outer shell 140. The covering element 11 of the door handle module 10 in FIG. 6 is arranged flush-mounted with the outer shell 140 of the door handle unit 100 such that the door handle module 10 cannot readily be recognized from the outside. Accordingly, the function of existing door handles 130 or door handle units 100 can be extended by a door handle module 10 according to the invention. In this case, the outer shaping of the door handle unit 100 is not significantly altered or adversely affected, since the door handle module 10, in particular the covering element 11, can be arranged in positive manner on the outer shell 140 of the door handle unit 100.

Figure 7:
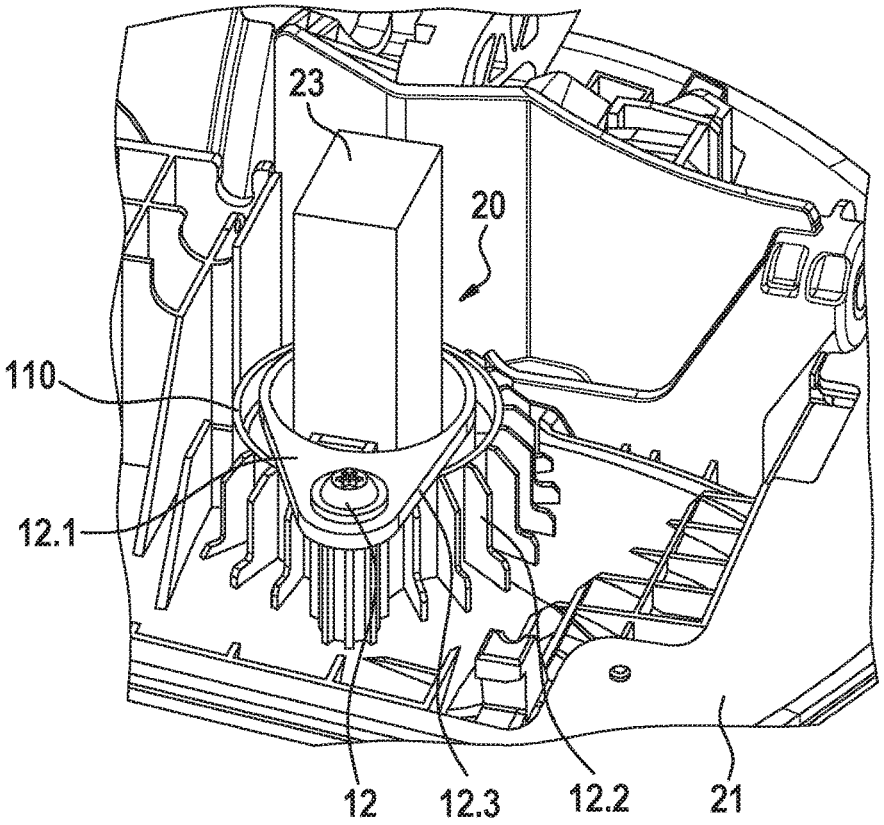

FIG. 7 shows a further view of the door handle unit 100 on an inner side 203 of the movable part 202 facing the vehicle 200. The door handle unit 100 in this case has the module receptacle 110, in which the door handle module 10 with the electronics unit 20 is arranged. The electronics unit 20 in this case has a communication element 21.2 which extends through the module receptacle 110, in particular through the guide portion 12.2 of the fastening means 12, and is preferably connected to a communication element 21.2 in a cavity of the covering element 11. The fastening adapter 12.1 is arranged with a fastening means 12 on the module receptacle 110. The communication element 21.2 is arranged in the cylindrically formed guide portion 12.2. On an outer contour of the outer shell 140 of the door handle unit 100 there runs a further electronic element 21 in the form of a sensor element 21.1, which is preferably designed as a proximity sensor 21.1. According to the invention, it is however conceivable for the electronic element 21 arranged on the outer shell 140 also to be designed as a communication element 21.2.

Figure 8:
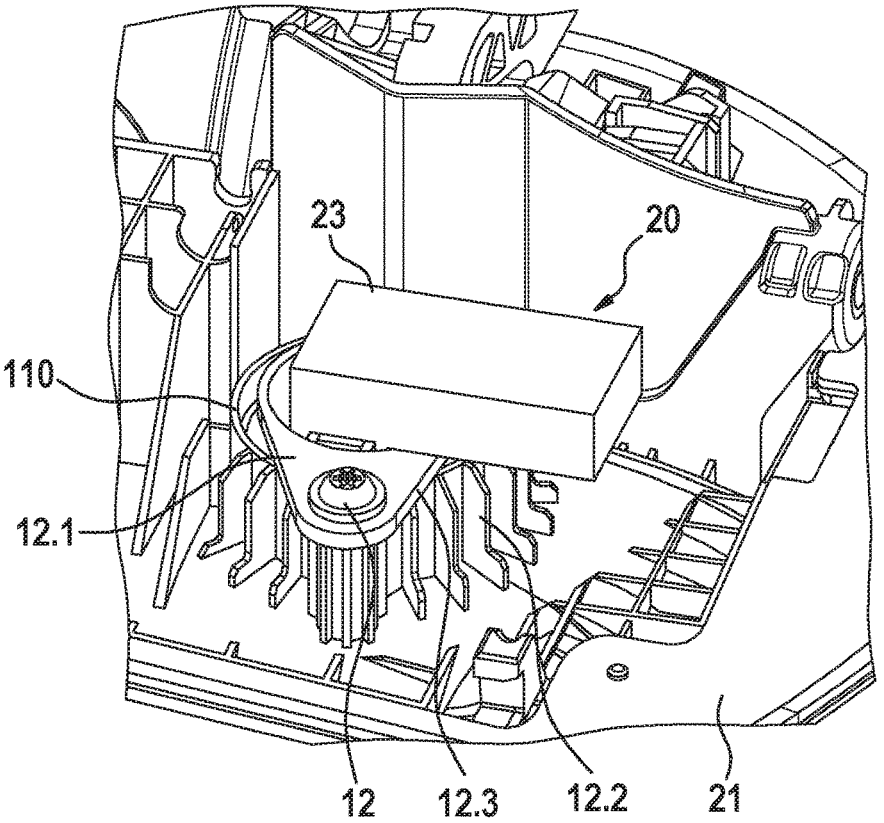

FIG. 8 shows a vehicle 200 with a movable part 202 in the form of a door 202 of a vehicle 200. On the movable part 202 there is shown on the side 201 facing away from the vehicle 200 a door handle unit 100 with a door handle module 10 according to the invention. The door handle module 10 in this case is configured such that at least communication between a security system of a vehicle 200 and a communication unit 30 can be produced by means of the electronics unit 20 of the door handle module 10.

LIST OF REFERENCE NUMERALS

10 door handle module
11 covering element
11.1 seal
11.2 gluing portion
12 fastening means
12.1 fastening adapter
12.2 guide portion
12.3 fastening arm
13 cutout
20 electronics unit
21 electronic element
21.1 sensor element, proximity sensor
21.2 communication element
21.3 transmission element
22 power module
30 communication unit, in particular ID transmitter, mobile telephone, smartphone
100 door handle unit
110 module receptacle/receptacle
120 door handle recess
130 door handle
140 outer shell
200 vehicle
201 side facing away from vehicle
202 movable part, door, gate

What is claimed is:

1. A door handle module for a door handle unit of a vehicle, for integrating an electronics unit for the door handle unit, comprising:

a covering element, on which an electronic element of the electronics unit is arranged, and fastening means;

wherein the covering element of the door handle module is configured to cover a module receptacle in the form of a lock cylinder receptacle used for fastening a mechanical lock cylinder of the door handle unit;

wherein the fastening means is configured as a fastening adapter, the fastening adapter has a cylindrical guide portion configured to be inserted within the lock cylinder receptacle, replacing the mechanical lock cylinder, and fastened to the module receptacle of the door handle unit; and wherein, when the covering element is covering the module receptacle, the cylindrical guide portion serves as a receptacle for an electric power module of the electronic unit.

2. Door handle module according to claim 1, wherein the module receptacle of the door handle unit can be closed by the covering element at least on a side facing away from the vehicle.

3. Door handle module according to claim 1, wherein the covering element is designed at least in portions to be electrically conductive.

4. Door handle module according to claim 1, wherein the electronic element has at least one of at least one sensor element or at least one wireless communication element.

5. Door handle module according to claim 1, wherein the electronic element is connected to at least one of the at least one sensor element or the at least one wireless communication element.

6. Door handle module according to claim 1, wherein at least a communication between a security system of the vehicle and the communication unit via at least one of the near-field or non-near-field communication element can be carried out by the electronic element.

7. Door handle module according to claim 1, wherein the electronics unit can be converted into a rest state and also into a wake state.

8. Door handle module according to claim 1, wherein the electronics unit preferably has at least one of a Bluetooth, NFC, infrared, GSM, LTE, UMTS, mobile communications, HF, UHF, LF, WLAN or USB interface.

9. Door handle module according to claim 1, wherein the fastening means makes possible at least positive, non-positive or positive fastening with the door handle unit.

10. Door handle module according to claim 1, wherein the fastening means is designed as a bayonet lock, screw closure or latch closure.

11. Door handle module according to claim 1, wherein the fastening adapter comprises at least one fastening arm, wherein the fastening arm preferably is designed to be orthogonal to the guide portion and can be connected in at least one of a non-positive or in a positive manner to the door handle unit, as a result of which the fastening adapter can be fixed to the door handle unit.

12. Door handle module according to claim 1, wherein the covering element has at least one of at least one seal or one gluing portion.

13. Door handle unit for actuating a lock of a movable part a vehicle, with a door handle for mechanical opening of the movable part a user, comprising:

a module receptacle in the form of a lock cylinder receptacle used for fastening a mechanical lock cylinder of the door handle unit, a door handle module for integrating an electronics unit for the door handle unit, comprising a covering element, on which an electronic element of the electronics unit is arranged, and fastening means;

wherein the fastening means is configured as a fastening adapter, the fastening adapter has a cylindrical guide portion configured to be inserted within the lock cylinder receptacle, replacing the mechanical lock cylinder, and fastened to the module receptacle of the door handle unit, and wherein, when the covering element is covering the module receptacle, the cylindrical guide portion serves as a receptacle for an electric power module of the electronic unit.

14. Door handle unit according to claim 13, wherein a proximity sensor is provided, which senses the approach of a user and is in a signal connection with the security system, so that a wish by the user to activate opening can be detected.

15. Door handle unit according to claim 13, wherein the door handle module is designed to be substantially flush-mounted with the door handle unit, in preferably an outer shell.

16. Door handle unit according to claim 15, wherein at least one of the door handle unit or the door handle module is an injection-molded plastics material part, wherein at least the electronics unit, preferably the electronic element, is encapsulated at least in portions.

17. Method for retrofitting an electromechanical or electrical access control system on a vehicle, wherein on a door handle unit, that includes a module receptacle in the form of a lock cylinder receptacle used for fastening a mechanical lock cylinder of the door handle unit and a door handle module for a door handle unit of the vehicle, for integrating an electronics unit for the door handle unit, the door handle module comprising:

a covering element, on which at least one electronic element of the electronics unit is arranged, and fastening means, wherein the fastening means is configured as a fastening adapter, the fastening adapter has a cylindrical guide portion configured to be inserted within the lock cylinder receptacle, replacing the mechanical lock cylinder of the door handle unit, and fastened to the module receptacle of the door handle unit, wherein, when the covering element is covering the module receptacle, the cylindrical guide portion serves as a receptacle for an electric power module of the electronic unit.

* * * * *